US008106318B2

(12) United States Patent
Bilder

(10) Patent No.: US 8,106,318 B2
(45) Date of Patent: Jan. 31, 2012

(54) WIRING STANDARD SELECTOR SWITCH

(76) Inventor: Geoffrey Bilder, Ottawa (CA)

( * ) Notice: Subject to any disclaimer, the term of this patent is extended or adjusted under 35 U.S.C. 154(b) by 177 days.

(21) Appl. No.: 12/608,075

(22) Filed: Oct. 29, 2009

(65) Prior Publication Data

US 2010/0233890 A1 Sep. 16, 2010

Related U.S. Application Data

(63) Continuation-in-part of application No. 12/401,951, filed on Mar. 11, 2009.

(51) Int. Cl.
*H01R 13/70* (2006.01)

(52) U.S. Cl. ..... 200/51.03; 200/293

(58) Field of Classification Search ..... 200/17 R
See application file for complete search history.

(56) References Cited

U.S. PATENT DOCUMENTS 4,501,424 A * 2/1985 Stone et al. ..... 273/148 B
4,579,407 A 4/1986 Shimada
6,080,942 A * 6/2000 Sasaki ..... 200/17 R
6,794,577 B1 9/2004 Bhogal
2005/0059291 A1 3/2005 Wood
2008/0274629 A1 11/2008 Meyer

FOREIGN PATENT DOCUMENTS

GB 2351853 A 10/2001

OTHER PUBLICATIONS

IEC L0582 T1 Cross-over Coupler publication (admitted prior art).
IEC L0585 T1 Cross-over Adapter publication (admitted prior art).
IEC L6001 Ethernet Crossover Adapter publication (admitted prior art).
Ossmann "The 5-In-1 Network Admin's Cable" publication (admitted prior art).
Canadian Office Action dated Feb. 25, 2011.

* cited by examiner

*Primary Examiner* — Elvin G Enad
*Assistant Examiner* — Lisa Homza
(74) *Attorney, Agent, or Firm* — MacMillan, Sobanski & Todd, LLC

(57) ABSTRACT

A wiring standard selector switch is used in a wired computer network and has the ability to easily switch between various network wiring standards, such as, for example, Rolled, ATM loopback, T1, Cross-over, and Straight-through. Rotating the switching collar causes the printed circuit board containing a wiring standard printed circuit to change the input/output relationship of the individual wires in the input and output network cables.

20 Claims, 7 Drawing Sheets

Figure 1

| T-568A | | | |
|---|---|---|---|
| Wire Number | Wire Colour | Pair | Description |
| 1 | white/green | 3 | TxData + |
| 2 | green | 3 | TxData - |
| 3 | white/orange | 2 | RxData + |
| 4 | blue | 1 | unused |
| 5 | white/blue | 1 | unused |
| 6 | orange | 2 | RxData - |
| 7 | white/brown | 4 | unused |
| 8 | brown | 4 | unused |

| T-568B | | | |
|---|---|---|---|
| Wire Number | Wire Colour | Pair | Description |
| 1 | white/orange | 2 | TxData + |
| 2 | orange | 2 | TxData - |
| 3 | white/green | 3 | RxData + |
| 4 | blue | 1 | unused |
| 5 | white/blue | 1 | unused |
| 6 | green | 3 | RxData - |
| 7 | white/brown | 4 | unused |
| 8 | brown | 4 | unused |

WIRING STANDARD SELECTOR SWITCH

CROSS-REFERENCE TO RELATED APPLICATIONS

This application is a continuation-in-part of U.S. patent application Ser. No. 12/401,951, filed Mar. 11, 2009, the disclosure of which is incorporated herein by reference.

BACKGROUND OF THE INVENTION

The present invention relates to wired computer network technologies. In particular, the present invention relates to a wiring standard selector switch capable of switching between multiple wiring standards used in wired computer networks, such as, cross-over and straight through, for example.

The present invention is an improvement over Canadian Patent Application No. 2,658,088, filed Mar. 11, 2009 wherein a universal network cable and a wiring standard selector switch are disclosed. Further developments have been revealed that outline the need for the production of an upgraded wiring standard selector switch. For a ready understanding of the current state of the wiring standard selector switch the reader is directed to Canadian Patent Application No. 2,658,088.

Wired computer networks generally consist of a plurality of network devices connected to each other using a plurality of network cables to enable data communication between each of the network devices. One of the most common forms of cabling that is used in wired networks are Category 5 (Cat5) Twisted Pair, which consists of 8 wires (4 pairs). Each of the four pairs of wires is colour coded with a primary wire (solid colour) and its counterpart secondary wire (striped colour), the T-568A and T-568B Cat5 network cable colouring schemes are presented in FIG. 1. To be able to connect the Cat5 network cable to network devices a male 8 Position 8 Contact (8P8C) connector or more commonly referred to as an RJ45 connector is fitted and crimped onto each end of the Cat5 network cable. Each of the primary and secondary wires at each end of the Cat5 cable is fitted into an 8P8C connector in a pre-determined order. The pre-determined wiring order are specific wiring standards and are dependant on a number of variables including, for example, the type of network device (e.g. a hub, router, network card, etc.) and whether the connection is directly connected (e.g. network card to network card) or routed through a network device (e.g. network card to network hub to network card). This is due to the fact that each of the primary and secondary wires is given a specific function which may differ between network devices, the specific function of each of the wires in the T-568A and T-568B Cat5 network cable colouring schemes are also presented in FIG. 1. Some of the more common wiring standards include, for example, crossover, straight-through, T1, ATM loopback, rolled, etc. In each of the aforementioned wiring standards it is necessary to use a specific Cat5 network cable, i.e. a cross-over cable, or a straight-through cable, to connect the network devices together.

Generally, when Network Technicians or the like are on the job they perform various tasks which may include, setting up a wired computer network, configuring network devices or troubleshooting network connectivity problems. These tasks require network connectivity between network devices and the Network Technicians=network device (in many instances this device is a notebook computer). Each of the network devices requiring the Network Technician to connect to may use a different wiring standard; thus requiring the Network Technician to have readily available a separate Cat5 network cable for each device connection. It can become expensive to purchase and cumbersome to carry all of the different types of Cat5 network cables the Network Technician might come across on the job. It would be beneficial for a Network Technician to achieve network connectivity with a variety of network devices having a variety of wiring standards using a single Cat5 network cable.

Canadian Patent Application No. 2,658,088, filed Mar. 11, 2009 (Bilder) describes a universal network cable and a wiring standard selector switch. The embodiment of the invention that is disclosed in the application uses a slidable switch actuating means to change between different wiring standards.

U.S. Pat. No. 6,794,577, issued Sep. 21, 2004 (Bhogal) describes cables used in computer networks and more specifically cables that incorporate multiple configuration settings. In an embodiment of the invention the network cable includes two connectors and a corresponding set of connector pins and signal wires. A coupling piece with at least two configuration settings controls the routing between the set of signal wires. The cable is transitionable between the at least two configuration settings with a hand settable switch, the position of the switch dictates the coupling configuration such as, a pass-through configuration and a crossover configuration, for example.

United States Patent Application No. 2008/0274629, published Nov. 6, 2008 (Meyer) describes an apparatus for enabling serial communication between two devices utilizing different cables, connectors or wiring schemes. An embodiment of the apparatus is composed of a rack-mountable housing with two RJ45 standard modular jacks for receiving RJ45 cables. The apparatus houses a plurality of electrical connections between the two RJ45 standard modular jacks, and the electrical connections effect a remapping of the signals between the two jacks. The remapping of the wiring may be implemented using wires connected between posts, using a printed circuit board, a programmable or processing device, or any other method for making the electrical connections between the two cable ports. The remapping of the wiring may be implemented or updated on the fly, using software or hardware switching or programming, or alternatively, hardwired at the time of manufacture. The electronic devices may each represent a component in a computer network, including, a personal computer, a router, a gateway, a modem, a printer, a scanner, a keyboard, a mouse, or any other electronic device capable of communication using a serial communication standard.

U.S. Pat. No. 4,579,407, issued Apr. 1, 1986 (Shimada) describes an interface cable, of the RS232C standard type interface, which can perform many kinds of cable connections. A plurality of changeover switches are provided between the RS232C connectors connected at the ends of the connecting cable, which contains multiple lines therein, the switches being used for selectively changing the connection with respect to at least a part of the multiple lines. By selectively turning >on= or >off= each of the changeover switches various kinds of cable connections can be performed using only a single cable, such as, between modem equipment and terminal equipment, between modem equipment to modem equipment, and between terminal equipment and terminal equipment, for example.

United States Patent Application No. 2005/0059291, published Mar. 17, 2005 (Wood) describes an improved method of assembling electrical connectors to wiring, such as, for example, RJ-45 connectors. The invention provides a connector plug with an internal circuit board for rerouting the wires, and a method of attaching wires from a multi-wire cable to an RJ-45 connector plug without the requirement to manually separate, sort and route individual wires to specific pins. The wires are attached to the connector plug in the same order that they are arranged within the cable. The circuit board with the connector plug, is interposed between the pins on the connector plug, which are connected to the cable wires, and the connector pins on the other end are attached to a wall jack or a device.

The present invention was made in recognition of the above-identified art and with a view to aiding Network Technicians too easily and more efficiently enable connectivity between two network devices having different wiring standards.

SUMMARY OF THE INVENTION

It is therefore an object of the present invention to provide a wiring standard selector switch capable of easily switching between a plurality of wiring standards used in computer networks.

Accordingly, as an aspect of the present invention, there is provided a wiring standard selector switch for use in wired computer networks, the switch comprising a first printed circuit board having thereon a wiring standard printed circuit defining a plurality of different network wiring standards. A second printed circuit board having thereon a set of input contacts and a set of output contacts arranged to be in electrical contact with the first printed circuit board and a set of input leads electrically connected to the set of input contacts and being adapted to receive an input connector and a set of output leads electrically connected to the set of output contacts and being adapted to receive an output connector. A selector switch enclosure being adapted to ensure that the first and second printed circuit boards are parallel and in electrical contact with each other and allowing the first printed circuit board to be longitudinally slidable in relation to the second printed circuit board via at least one longitudinal guiding slot. A switching collar rotatably mounted on the outer surface of the selector switch enclosure having at least one guiding cam groove on its inner surface for guiding at least one stud of a cam follower that is adapted to be rigidly affixed to the first printed circuit board. Whereby the rotating mechanical action from a rotation of the switching collar at predetermined amounts is converted into a longitudinal mechanical action via the at least one guiding cam groove, the at least one longitudinal guiding slot and the at least one stud causes the cam follower which is rigidly affixed to the first printed circuit board to longitudinally slide at predetermined space intervals. The set of input contacts and the set of output contacts engage the wiring standard printed circuit so as to establish a different complete circuit at each of the predetermined space intervals between each of the set of input leads and the set of output leads. Each of the different complete circuits correspond to one of the plurality of different network wiring standards.

The set of input leads and the set of output leads of the present invention may be electrically connected to an input network cable and an output network cable, respectively and preferable that the input network cable and the output network cable are each fitted with a male connector.

The set of input leads and the set of output leads of the present invention may be electrically connected to an input female connector and an output network cable, respectively and preferable that the output network cable is fitted with a male connector.

The set of input leads and the set of output leads of the present invention may be electrically connected to an input network cable and an output female connector, respectively and preferable that the input network cable is fitted with a male connector.

The set of input leads and the set of output leads of the present invention may be electrically connected to an input female connector and an output female connector, respectively.

The set of input contacts and the set of output contacts of the present invention are preferably made of an electrically conducting material with low corroding properties, for example, but not limited to, aluminum, copper, gold, etc.

The set of input contacts and the set of output contacts of the present invention are preferably of any type known in the art, for example, but not limited to, brush contacts, spring loaded contacts, omega contacts, u-shaped contacts, finger contacts, etc.

The predetermined amounts of the present invention are preferably defined on the selector switch enclosure by a series of markings on the cover and more preferably are index labels indicating the network wiring standard selected.

The set of input contacts and the set of output contacts of the present invention preferably contain the same number of contacts and, in a preferred embodiment, each set is linearly arranged perpendicular to the slidable direction.

The wiring standard printed circuit of the present invention defines a series of circuit connectors arranged in a grid pattern with columns equal to the number predetermined space intervals and rows equal to the number of contact members in either the set of input contacts or the set of output contacts.

The set of input contacts of the present inventions are preferably in electrical contact with only one column of the series of circuit connectors at each of the predetermined space intervals.

The set of output contacts of the present invention are preferably always in electrical contact with one column of the series of circuit connectors.

The number of contacts in each of the set of input contacts and the set of output contacts of the present invention is preferably equal to 8.

The selector switch enclosure and switching collar of the present invention are preferably made from a hard durable plastic. When the set of input leads or the set of output leads of the present invention are electrically connected to a network cable, it is preferable that the network cable and selector switch enclosure is fitted with a durable and flexible rubber strain relief mechanism.

The male connector of the present invention is preferably a 8 Position 8 Contact (8P8C) plug. The female connector of the present invention is preferably an 8 Position 8 Contact (8P8C) socket.

The network cable of the present invention is preferably any 4 pair twisted network cable and more preferably is a Category 5 or higher grade network cable.

The different network wiring standards of the present invention preferably include, but are not limited to, Rolled, ATM loopback, T1, Cross-over, and Straight-through.

Various aspects of this invention will become apparent to those skilled in the art from the following detailed description of the preferred embodiment, when read in light of the accompanying drawings.

BRIEF DESCRIPTION OF THE DRAWINGS

Embodiments of the present invention will be further described, by way of example, with reference to the accompanying drawings, in which:

FIG. 1 depicts a wiring colour scheme of a typical four pair twisted network cable;

DETAILED DESCRIPTION OF THE INVENTION

Standard network cables that are used in wired computer networks are compatible with only one type of wiring standard, such as, straight through or cross-over, for example. Network technicians, or the like, who need network connectivity with various network devices may, on any given day, encounter a number of different wiring standards, and as a result, must be equipped with a different type of network cable for each of the wiring standards. The present invention overcomes this difficulty by providing a wiring standard selector switch capable of switching between a plurality of wiring standards, thus enabling a Network technician, or the like, to be equipped with only a single network cable.

Figure 2:
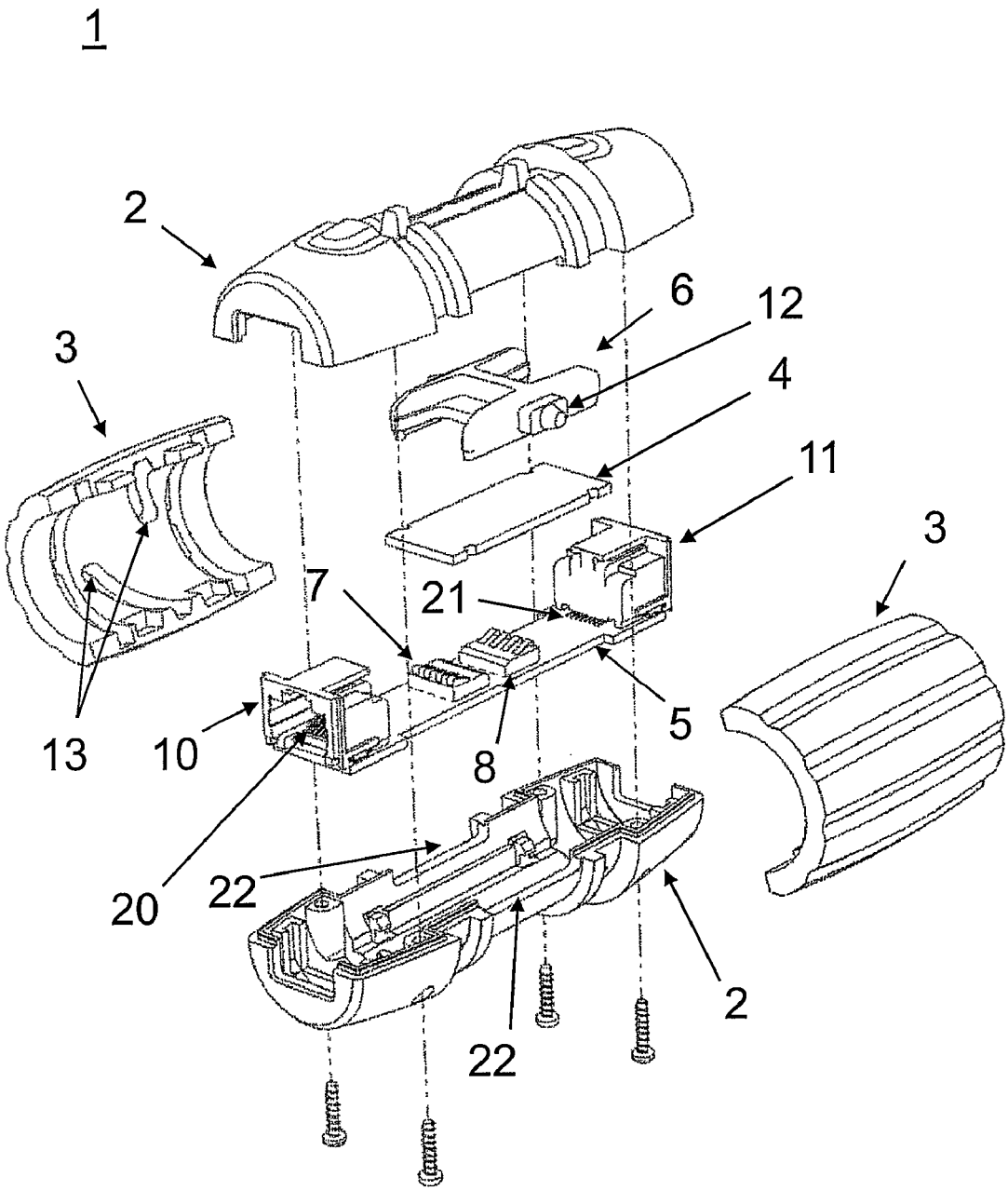
FIG. 2 is a 3-dimensional exploded view of the wiring standard selector switch of an embodiment of the present invention.
Figure 3:
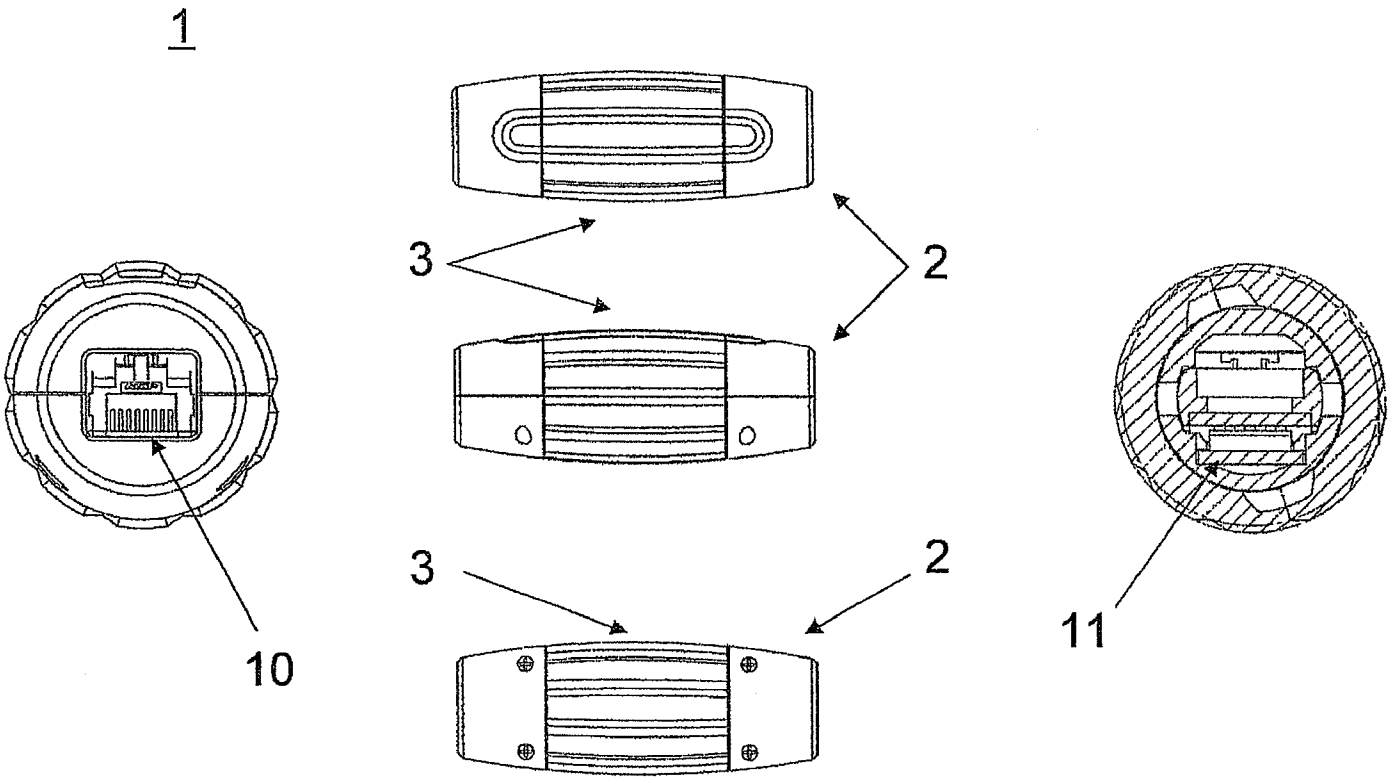
FIG. 3 is a plurality of perspective side views of an embodiment of the wiring standard selector switch of the present invention.
Figure 4:
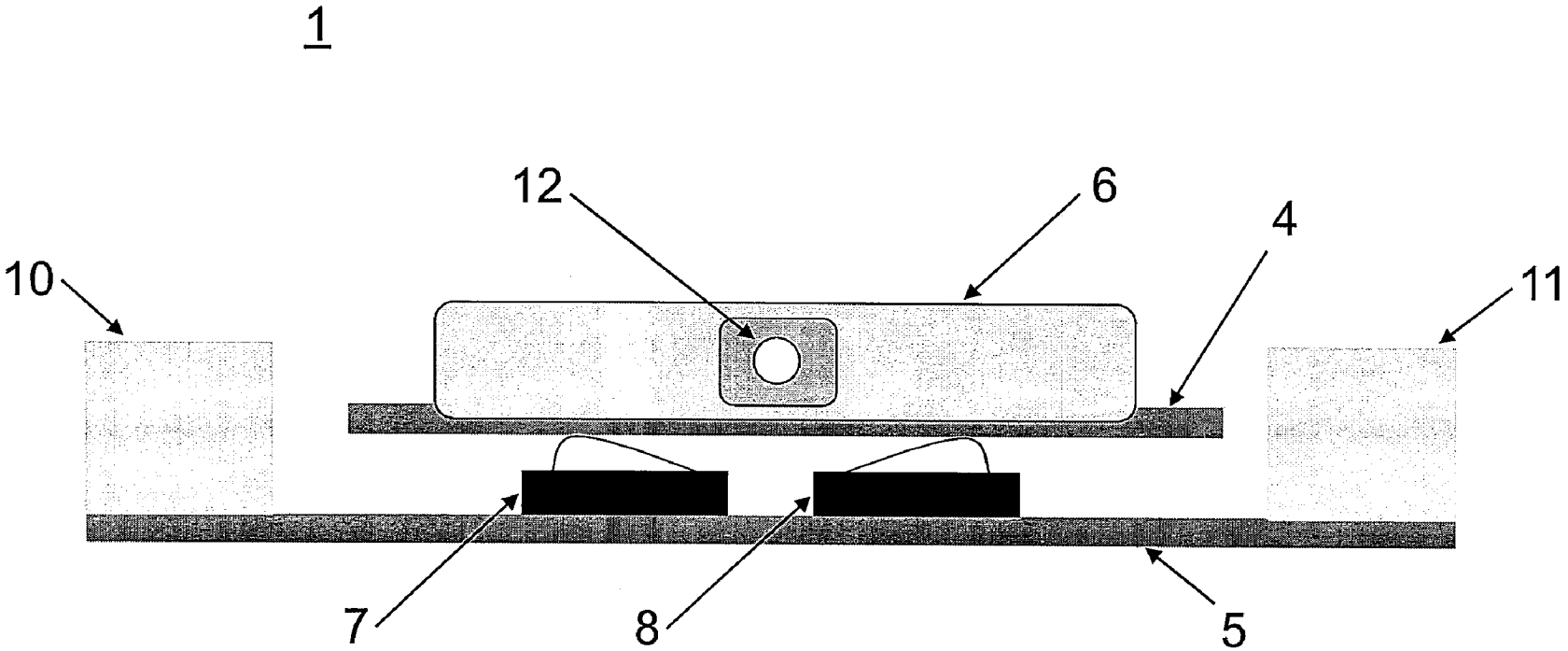
FIG. 4 is cross-sectional view of the internal components of an embodiment of the wiring standard selector switch of the present invention.

FIGS. 2 to 4 show different views of the wiring standard selector switch of an embodiment of the present invention. The wiring standard selector switch (1) may consist of an enclosure (2), a switching collar (3), a first printed circuit board (4), a second printed circuit board (5), and a cam follower (6). The second printed circuit board (5) has thereon a set of input contacts (7) and set of output contacts (8) that arranged to be in electrical contact with a wiring standard printed circuit (9) that is defined on the first printed circuit board (4). The wiring standard printed circuit (9) defines a plurality of network wiring standards which create an electrical signal path between each of the set of input contacts (7) and the set of output contacts (8). The second printed circuit board (5) also has thereon a set of input leads (20) electrically connected to the set of input contacts (7) and being adapted to receive an input connector (10) and a set of output leads (21) electrically connected to the set of output contacts (8) and being adapted to receive an output connector (11). The input connector (10) and the output connector (11) shown in FIGS. 2 and 3 show an embodiment where the connectors are 8P8C Female Sockets. The enclosure (2) surrounds and protects the internal components of the switch (1) and is adapted to ensure that the first printed circuit board (4) and the second printed circuit board (5) are kept parallel and in constant electrical contact with each other. The enclosure (2) is also adapted to allow the first printed circuit board (4) to be longitudinally slidable in relation to the second printed circuit board (5) via cam studs (12) on the cam follower (6) that is adapted to be rigidly affixed to the first printed circuit board (4) along longitudinal guiding slots (22). As seen in FIG. 2, the longitudinal slots (22) are formed when enclosure (2) is enclosed. However, any enclosure adapted to the purpose of the invention herein may be used as known to a person skilled in the art. The switching collar (3) is rotatably mounted on the outer surface of the enclosure (2) and has guiding cam grooves (13) on its inner surface for facilitating the longitudinal motion of the first printed circuit board (4). The rotating mechanical action(movement) from a rotation of the switching collar (3) by a predetermined amount is converted into a longitudinal mechanical action(movement) via a combination of the guiding cam grooves (13), the longitudinal guiding slots, and cam studs (12) to cause the cam follower (6), which is rigidly affixed to the first printed circuit board (4), to longitudinally slide at predetermined space intervals. The set of input contacts (7) and the set of output contacts (8) engage the wiring standard printed circuit so as to establish a different complete circuit at each of the predetermined space intervals between each of the set of input leads and the set of output leads. Each of the different complete circuits correspond to one of the plurality of different network wiring standards. Once a wiring standard is chosen the switch is locked into place, creating a secure electrical circuit without fear of losing connection.

Figure 5:
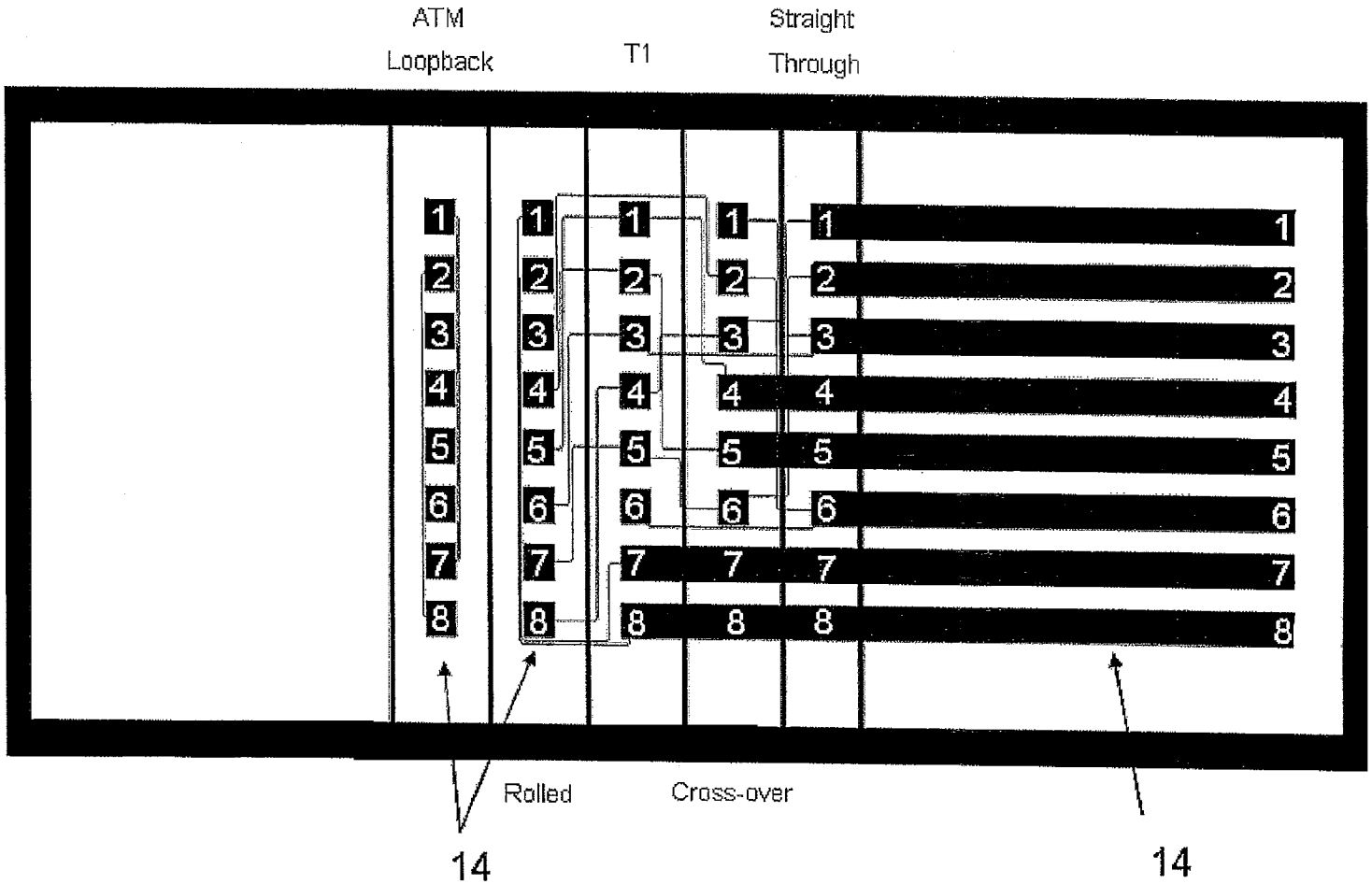
FIG. 5 is a perspective top view of an embodiment of the printed circuit board.

FIG. 5 is a perspective view of an embodiment of the wiring standard printed circuit (9). The printed circuit conductors (14) on the output side (right side of FIG. 5) of the wiring standard printed circuit (9) are positioned and aligned in such a way that at any given time the set of output contacts (8) are always in electrical contact with each other. The printed circuit conductors (14) on the input side (left side of FIG. 5) of the wiring standard printed circuit (9) are positioned and aligned such that at any given time only the desired column (wiring standard selection) of printed circuit conductors (13) are in electrical contact with the set of input contacts (7). This allows the wiring standard selector switch (1) to be manually set between network wiring standards without fear of having improper or loose electrical connections.

Figure 6:
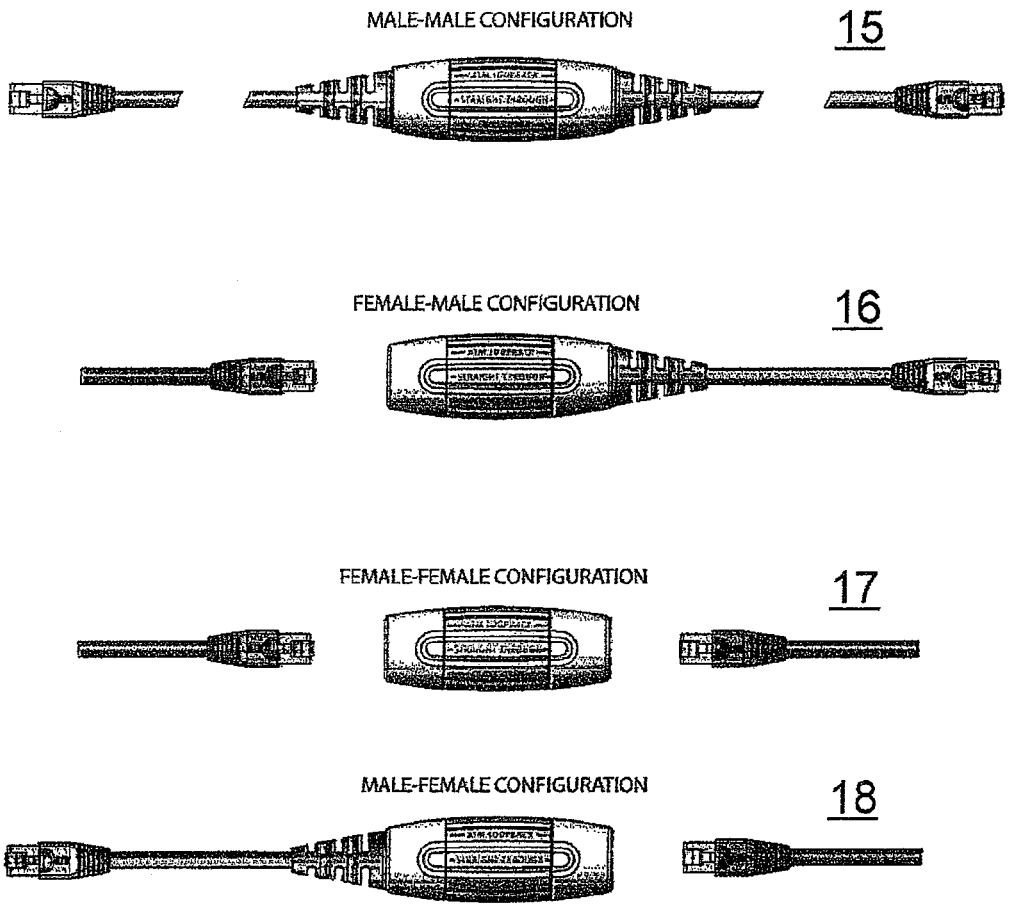
FIG. 6 is a plurality of side views of various embodiments of the present invention.

To provide customizability, the wiring standard selector switch (1) may be provided with different configurations of an input connector (10) paired with output connector (11), some of which are shown in FIG. 6. The different combinations may be, a male plug input connector paired with a male plug output connector (15), a female socket input connector paired with a male plug output connector (16), a female socket input connector paired with a female socket output connector (17), a male plug input connector paired with a female socket output connector (18). The configurations containing the female socket connectors allow the Network Technician, or the like, to selectively use pre-made network cables to be used in conjunction with the wiring standard selector switch (1).

Figure 7:
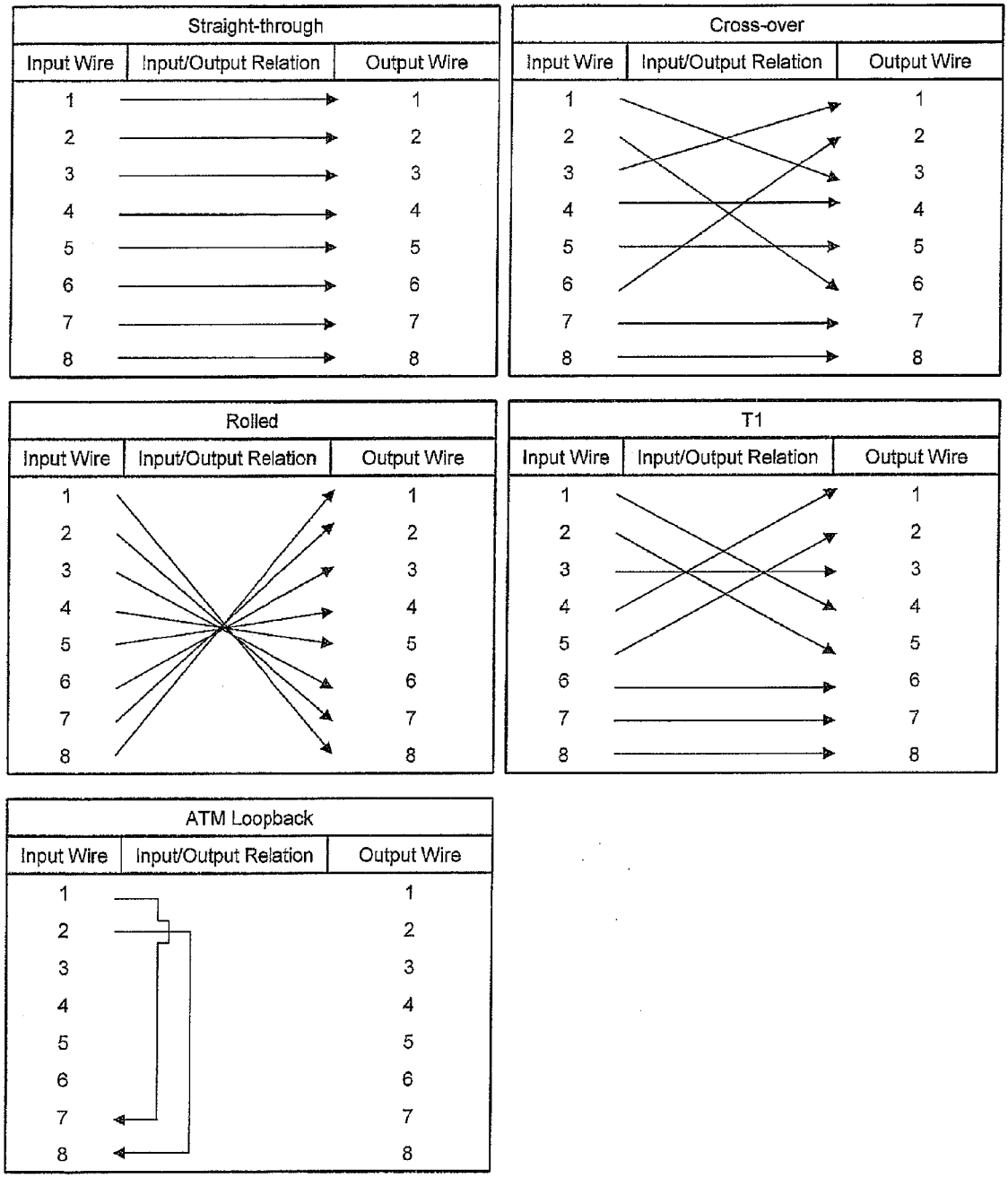
FIG. 7 is a plurality of tables showing the input/output relations of individual wires in a typical four pair twisted network cable of five common wiring standards.

FIG. 7 presents a set of tables that correspond to different wiring standards. For each wiring standard, the table defines the paired electrical connection between each of the set of input contacts (7) and the set of output contacts (8).

Cam systems are commonly known in the art, and are not specific to the present invention. Thus it will be known to one skilled in the art how to integrate such devices with the selector switch enclosure described herein.

Electrical contacts are commonly known in the art, and are not specific to the present invention. Thus it will be known to one skilled in the art how to integrate such devices with the wiring standard printed circuit (9) described herein.

Network cables are commonly known in the art, and are not specific to the present invention. Thus it will be known to one skilled in the art how to integrate such devices with the wiring standard selector switch described herein.

Printed circuits boards are commonly known in the art, and are not specific to the invention. Thus, it will be known to one skilled in the art how to design and integrate such a device together with the wiring standard selector switch (1) described herein.

The foregoing is an exemplary embodiment of the present invention and a person skilled in the art would appreciate that modifications to these embodiments may be made without departing from the scope and spirit of the invention.

What is claimed is:

1. A wiring standard selector switch comprising:

a first printed circuit board having thereon a wiring standard printed circuit defining a plurality of different network wiring standards;

a second printed circuit board having thereon a set of input contacts and a set of output contacts arranged to be in electrical contact with the first printed circuit board and a set of input leads electrically connected to the set of input contacts and being adapted to receive an input connector and a set of output leads electrically connected to the set of output contacts and being adapted to receive an output connector;

a selector switch enclosure being adapted to ensure that the first printed circuit board and the second printed circuit board are parallel and in electrical contact with each other and allowing the first printed circuit board to be longitudinally slidable in a slidable direction in relation to the second printed circuit board via at least one longitudinal guiding slot; and a switching collar rotatably mounted on the outer surface of the selector switch enclosure having at least one helical guiding cam groove on its inner surface for guiding at least one stud of a cam follower that is adapted to be rigidly affixed to the first printed circuit board;

whereby a rotating mechanical action from a rotation of the switching collar at predetermined amounts is converted into a longitudinal mechanical action via a combination of the at least one helical guiding cam groove, the at least one longitudinal guiding slot and the at least one stud causes the cam follower which is rigidly affixed to the first printed circuit board to longitudinally slide at predetermined space intervals, the set of input contacts and the set of output contacts engage the wiring standard printed circuit so as to establish a different complete circuit at each of the predetermined space intervals between each of the set of input leads and the set of output leads, wherein each of the different complete circuits correspond to one of the plurality of different network wiring standards.

2. The wiring standard selector switch according to claim 1, wherein the set of input contacts and the set of output contacts each contain the same number of contacts and each set is linearly arranged perpendicular to the slidable direction;

wherein the wiring standard printed circuit board defines a series of circuit connectors arranged in a grid pattern with columns equal to the number predetermined space intervals and rows equal to the number of contact members in either the set of input contacts or the set of output contacts;

wherein the set of input contacts are in electrical contact with only one column of the circuit connectors at each of the predetermined space intervals; and wherein the set of output contacts are in constant electrical contact with one column of the circuit connectors.

3. The wiring standard selector switch according to claim 2, wherein the set of input leads and the set of output leads are electrically connected to an input network cable fitted with a male connector and an output network cable fitted with another male connector, respectively.

4. The wiring standard selector switch according to claim 3, wherein each male connector is an 8 position 8 contact plug.

5. The wiring standard selector switch according to claim 4, wherein the network cables are Category 5 or higher grade network cables.

6. The wiring standard selector switch according to claim 3, wherein the network cables are Category 5 or higher grade network cables.

7. The wiring standard selector switch according to claim 2, wherein the set of input leads and the set of output leads are electrically connected to an input female connector and an output network cable fitted with a male connector, respectively.

8. The wiring standard selector switch according to claim 7, wherein the male connector is an 8 position 8 contact plug and the female connector is an 8 position 8 contact socket.

9. The wiring standard selector switch according to claim 8, wherein the network cable is a Category 5 or higher grade network cable.

10. The wiring standard selector switch according to claim 7, wherein the network cable is a Category 5 or higher grade network cable.

11. The wiring standard selector switch according to claim 2, wherein the set of input leads and the set of output leads are electrically connected to an input network cable fitted with a male connector and an output female connector, respectively.

12. The wiring standard selector switch according to claim 11, wherein the male connector is an 8 position 8 contact plug and the female connector is an 8 position 8 contact socket.

13. The wiring standard selector switch according to claim 12, wherein the network cable is a Category 5 or higher grade network cable.

14. The wiring standard selector switch according to claim 11, wherein the network cable is a Category 5 or higher grade network cable.

15. The wiring standard selector switch according to claim 2, wherein the set of input leads and the set of output leads are electrically connected to an input female connector and an output female connector, respectively.

16. The wiring standard selector switch according to claim 15, wherein each female connector is an 8 position 8 contact socket.

17. The wiring standard selector switch according to claim 2, wherein the number of contacts in each of the set of input contacts and the set of output contacts is equal to 8.

18. The wiring standard selector switch according to claim 2, wherein the set of input contacts and the set of output contacts are selected from the group consisting of electrical finger contacts, electrical u-shaped contacts, electrical omega contacts, spring loaded electrical contacts, and electrical brush contacts.

19. The wiring standard selector switch according to claim 2, wherein the predetermined amounts are defined by a series of markings on the selector switch enclosure; and wherein the series of markings are index labels indicating the network wiring standard selected.

20. The wiring standard selector switch according to claim 2, wherein the plurality of different network wiring standards include: Rolled, ATM loopback, T1, Cross-over, or Straight-through.

* * * * *